US009970086B2

(12) United States Patent
Mouri et al.

(10) Patent No.: US 9,970,086 B2
(45) Date of Patent: May 15, 2018

(54) MACHINE COMPONENT MADE OF FERROUS SINTERED METAL

(71) Applicants: Toshihiko Mouri, Aichi (JP); Hiroharu Nagata, Aichi (JP)

(72) Inventors: Toshihiko Mouri, Aichi (JP); Hiroharu Nagata, Aichi (JP)

(73) Assignee: NTN CORPORATION, Osaka (JP)

( * ) Notice: Subject to any disclaimer, the term of this patent is extended or adjusted under 35 U.S.C. 154(b) by 391 days.

(21) Appl. No.: 14/427,157

(22) PCT Filed: Aug. 21, 2013

(86) PCT No.: PCT/JP2013/072280

§ 371 (c)(1),
(2) Date: Mar. 10, 2015

(87) PCT Pub. No.: WO2014/041976

PCT Pub. Date: Mar. 20, 2014

(65) Prior Publication Data

US 2015/0232966 A1 Aug. 20, 2015

(30) Foreign Application Priority Data

Sep. 12, 2012 (JP) ..... 2012-200340

(51) Int. Cl.
*C22C 33/02* (2006.01)
*B22F 3/12* (2006.01)
(Continued)

(52) U.S. Cl.
CPC ..... *C22C 33/0257* (2013.01); *B22F 1/007* (2013.01); *B22F 3/12* (2013.01);
(Continued)

(58) Field of Classification Search
CPC ..... C22C 33/2027; C22C 38/16
See application file for complete search history.

(56) References Cited

U.S. PATENT DOCUMENTS 3,853,642 A 12/1974 Esper et al.
4,702,771 A * 10/1987 Takagi ..... C22C 33/0207 75/237
(Continued)

FOREIGN PATENT DOCUMENTS

CN 1904118 1/2007
JP 48-44108 6/1973
(Continued)

OTHER PUBLICATIONS

Extended European Search Report dated May 4, 2016 in corresponding European patent application No. 13 83 7683.
(Continued)

*Primary Examiner* — Colleen P Dunn
*Assistant Examiner* — Rajinder Bajwa
(74) *Attorney, Agent, or Firm* — Wenderoth, Lind & Ponack, L.L.P.

(57) ABSTRACT

Raw material powder containing iron powder, copper powder, and tin powder is compressed to form a green compact. The green compact is sintered in a temperature range of from 750 to 900° C., to bond iron structures to each other with copper and tin.

3 Claims, 3 Drawing Sheets

(51) Int. Cl.

| | |
|---|---|
| ***B22F 1/00*** | (2006.01) |
| ***B22F 5/00*** | (2006.01) |
| ***C22C 38/16*** | (2006.01) |
| ***C22C 38/00*** | (2006.01) |
| ***F01L 1/047*** | (2006.01) |

(52) U.S. Cl.
CPC ..... *B22F 5/00* (2013.01); *C22C 38/008* (2013.01); *C22C 38/16* (2013.01); *F01L 1/047* (2013.01)

(56) References Cited

U.S. PATENT DOCUMENTS

| | | | | |
|---|---|---|---|---|
| 8,283,046 | B2 * | 10/2012 | Takayama | B22F 7/04 29/898.14 |
| 2012/0177528 | A1 * | 7/2012 | Takayama | B22F 3/10 419/38 |
| 2013/0101244 | A1 * | 4/2013 | Nishizawa | C22C 9/00 384/279 |

FOREIGN PATENT DOCUMENTS

| | | | |
|---|---|---|---|
| JP | 51-14804 | | 2/1976 |
| JP | 8-41607 | | 2/1996 |
| JP | 9-41069 | | 2/1997 |
| JP | 9-41070 | | 2/1997 |
| JP | 9-41071 | | 2/1997 |
| JP | 9-49047 | | 2/1997 |
| JP | 9-49063 | | 2/1997 |
| JP | 9-49064 | | 2/1997 |
| JP | H0949063 | * | 2/1997 |
| JP | 2007-246939 | | 9/2007 |
| JP | 2008-202123 | | 9/2008 |
| JP | 2011-226470 | | 11/2011 |
| WO | 2006/080554 | | 8/2006 |
| WO | 2011/122558 | | 10/2011 |

OTHER PUBLICATIONS

Office Action dated Nov. 8, 2016 in corresponding Chinese Application No. 201380045705.9, with English translation.

English translation of International Preliminary Report on Patentability and Written Opinion dated Mar. 17, 2015 in PCT/JP2013/072280.

International Search Report dated Nov. 19, 2013 in International (PCT) Application No. PCT/JP2013/072280.

Office Action dated Mar. 24, 2016 in corresponding Chinese Application No. 201380045705.9, with English translation.

* cited by examiner

MACHINE COMPONENT MADE OF FERROUS SINTERED METAL

TECHNICAL FIELD

The present invention relates to a machine part comprising an iron-based sintered metal.

BACKGROUND ART

An oil seal for a variable valve timing mechanism (hereinafter also referred to simply as oil seal) is required to have high dimensional accuracy with a view to enhancing sealing property. Therefore, the oil seal is sometimes formed of a sintered metal allowing for forming with high accuracy. In this case, an iron-based sintered metal is often used from the view point of material cost. In general, the iron-based sintered metal is formed by the following procedure: raw material powder obtained by mixing iron powder with trace amounts of graphite powder and copper powder is subjected to compression molding, to form a green compact; and the green compact is sintered at high temperature (1,100° C. or more). Through such procedure, carbon in graphite is diffused in an iron structure to form a pearlite phase, and copper is dissolved as a solid solution in the iron structure. Thus, the sintered compact to be obtained has high strength.

In the sintering of a green compact at high temperature as described above, demanded dimensional accuracy may not be obtained unless the green compact is heated uniformly, because its shrinkage amount varies with location. Therefore, the sintering needs to be performed in a state in which the green compacts are aligned so that their directions and postures are uniformized. However, the green compacts before the sintering have low strength, and hence have a risk of being damaged when being grabbed by a robot hand or the like in the alignment of the green compacts. For example, in Patent Literature 1, green compacts are prevented from being damaged by subjecting the green compacts in a non-aligned state to provisional sintering at relatively low temperature (approximately from 750 to 900° C.), to increase their strength to some extent, followed by sintering the provisionally sintered compacts in an aligned state at high temperature.

CITATION LIST

Patent Literature 1: JP 2007-246930 A

SUMMARY OF INVENTION

Technical Problem

However, only a relatively small load such as a pressing load to a housing by a leaf spring or a shear force by hydraulic pressure is applied to the oil seal for a variable valve timing mechanism. When such machine part is formed of an iron-based sintered metal disclosed in Patent Literature 1, the productivity lowers owing to the necessity for a sintering step in two stages, and strength higher than necessary is imparted.

For example, when the green compact is formed by using general raw material powder for the iron-based sintered metal containing iron powder, copper powder, and graphite powder, and the green compact is sintered at relatively low temperature (for example, from 750 to 900° C. a pearlite phase is hardly formed because carbon is not sufficiently diffused in the iron structure. Thus, the iron structure is formed mainly of a relatively soft ferrite phase. In addition, copper is not dissolved as a solid solution in the iron structure at such low sintering temperature, and the strength of a sintered compact is not increased by copper. Therefore, the sintered compact thus obtained has significantly low strength as compared to a sintered compact obtained through sintering at a general sintering temperature (from 1,100 to 1,150° C.). The verification made by the inventors of the present invention revealed that the obtained sintered compact had static strength only about 0.2 times as high as that of the general sintered compact. As described above, simply adopting a low sintering temperature does not achieve demanded strength even for a machine part to which a relatively small load is applied, because the strength of the sintered compact becomes excessively low.

An object to be achieved by the present invention is to provide a machine part formed of an iron-based sintered metal, which has a certain level of strength and high productivity.

Solution to Problem

According to one embodiment of the present invention, which has been made to achieve the above-mentioned object, there is provided a machine part, comprising an iron-based sintered metal, the iron-based sintered metal having an iron structure formed mainly of a ferrite phase, and having blended therein copper and tin for bonding the iron structures to each other. The machine part may be manufactured by a manufacturing method comprising the steps of: comprising raw material powder containing iron powder, copper powder, and tin powder, to form a green compact; and sintering the green compact in a temperature range of from 750 to 900° C., to bond iron structures to each other with copper and tin.

When the green compact of the raw material powder containing iron powder is sintered at relatively low temperature as described above, the iron structures are bonded to each other with copper and tin, and hence a certain level of strength can be ensured, while the strength is lower than that in the case of a conventional iron-based sintered metal formed mainly of a pearlite phase because the iron structure is formed mainly of a ferrite phase. Specifically, molten tin is brought into contact with copper to form a liquid phase, and a copper-tin alloy in a state of a liquid phase penetrates between the iron structures to bond the iron structures to each other (liquid phase sintering). In this case, elemental tin has a low force to bond the iron structures to each other owing to its low wettability to iron, but when tin forms an alloy with copper having high wettability to iron, the iron structures can be bonded to each other strongly to some extent. The verification made by the inventors of the present invention revealed that a sintered compact thus obtained had static strength about 0.4 times as high as that of a sintered compact obtained by sintering a green compact of general raw material powder for the iron-based sintered metal at a general sintering temperature (from 1,100 to 1,150° C.). A machine part having strength of that level can be sufficiently put to practical use as a machine part to be used for an application in which a relatively small load is applied (for example, an oil seal for a variable valve timing mechanism). Through the sintering at low temperature, the shrinkage amount of the green compact during sintering is reduced, and hence demanded dimensional accuracy can be ensured without sintering the green compacts in an aligned state.

This eliminates the need to perform a sintering step in two stages as in Patent Literature 1, and thus the productivity is increased.

When graphite powder is blended in the raw material powder, carbon in graphite is hardly diffused in the iron structure by virtue of a relatively low sintering temperature. In addition, carbon is prevented from being diffused in the iron structure by the copper-tin alloy penetrating between the iron structures. Therefore, most of graphite remains as free graphite in the sintered metal. For example, in the case where the machine part is a machine part for sliding with respect to another part, abrasion can be suppressed by enhancing slidability through exposure of free graphite to a sliding surface with the other part.

It is preferred that the machine part be formed of, for example, a sintered metal comprising 1 to 10 wt % (preferably 1 to 8 wt %) of copper, 0.5 to 2 wt % of tin, and 0.1 to 0.5 wt % of carbon, with the balance being iron. The reasons for the upper limits and lower limits of the blending ratios of the materials are hereinafter described. When the blending ratio of copper is leas than 1 wt % or the blending ratio of tin is less than 0.5 wt %, the copper-tin alloy present between the iron structures is excessively reduced in amount, which may result in a reduction in the force to bond the iron structures to each other and then poor strength. When the blending ratio of copper exceeds 8 wt %, a strength increasing effect is less improved. When the blending ratio of copper exceeds 10 wt %, a further increase in the blending ratio offers no further increase in the strength. Therefore, it is desired to set the blending ratio of copper to 10 wt % or less, preferably 8 wt % or less with a view to limiting the blending amount of copper, which is expensive, to a bare minimum. When the blending ratio of tin exceeds 2 wt %, there is no further improvement in the force to bond the iron structures to each other through alloying with copper. Therefore, the blending ratio of tin is set to 2 wt % or less with a view to limiting the blending amount of tin, which is expensive, to a bare minimum. In the sintering at relatively low temperature of from 750 to 900° C., a blending ratio of tin to copper of ⅕ or more and 1 or less in terms of weight ratio is most effective for enhancing the strength. When the ratio exceeds 1, tin is more likely to be precipitated. When the blending ratio of carbon is less than 0.1 wt %, a slidability enhancing effect by free graphite is not obtained, and when the blending ratio of carbon exceeds 0.5 wt %, the cost rises.

Advantageous Effects of Invention

As described above, according to one embodiment of the present invention, the machine part formed of an iron-based sintered metal, which has a certain level of strength and excellent productivity can be provided.

BRIEF DESCRIPTION OF DRAWINGS

FIG. 1(*b*) is a sectional view taken along the line X-X of FIG. 1(*a*).

FIG. 1(*c*) is a sectional view taken along the line Y-Y of FIG. 1(*a*).

FIG. 2(*b*) is a side view of the oil seal.

FIG. 2(*c*) is a front view of the oil seal.

DESCRIPTION OF EMBODIMENTS

Now, embodiments of the present invention are described with reference to the drawings.

Figure 1A:
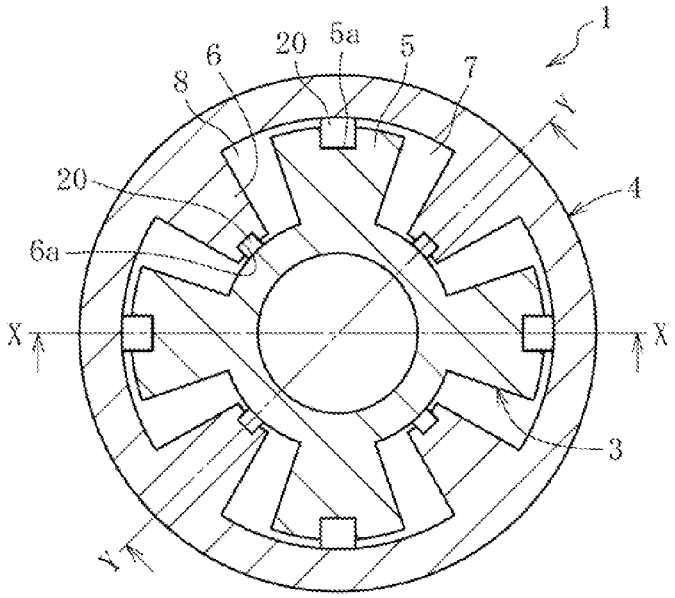
FIG. 1(*a*) is a sectional view of a variable valve timing mechanism in a direction perpendicular to an axial direction of a cam shaft.
Figure 1B:
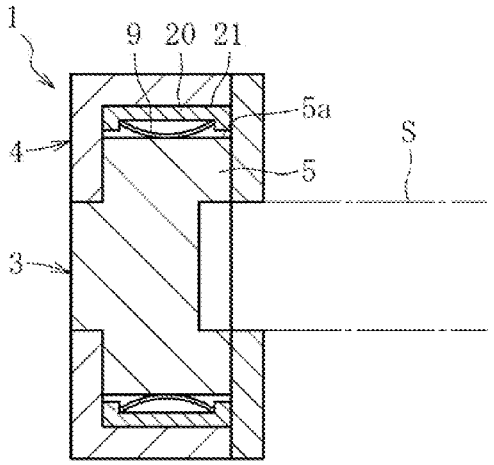
Figure 1C:
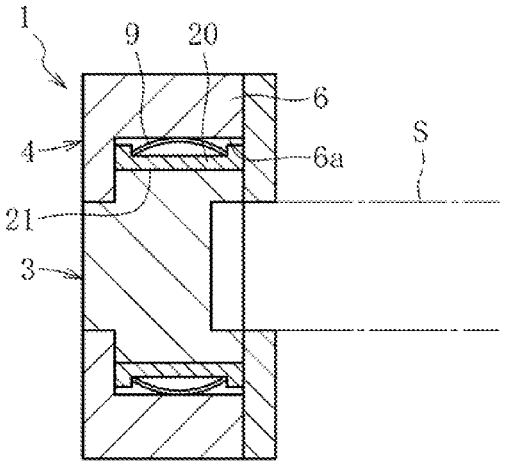

FIG. 1 illustrates a variable valve timing mechanism 1 having incorporated therein an oil seal 20 as a machine part according to one embodiment of the present invention. The variable valve timing mechanism 1 includes: a rotor 3, which is configured to rotate in an integrated manner with a cam shaft S; and a housing 4, which is configured to rotate in a synchronized manner with a crankshaft (not shown) in an engine and house the rotor 3 so that the rotor 3 is relatively rotatable.

As illustrated in FIG. 1(*a*), the rotor 3 includes a plurality of vanes 5 (four vanes in the illustrated example) projecting in an outer circumferential side. The housing 4 includes a plurality of teeth 6 (four teeth in the illustrated example) projecting between the plurality of vanes 5 in a circumferential direction. Hydraulic chambers 7, 8 are formed between the vanes 5 and the teeth 6 in the circumferential direction. The hydraulic chamber 7 on one side of the vane 5 in the circumferential direction forms an advance chamber in which hydraulic pressure is supplied upon driving of the rotor 3 in an advance direction. The hydraulic chamber 8 on the other side of the vane 5 in the circumferential direction forms a retard chamber in which hydraulic pressure is supplied upon driving of the rotor 3 in a retard direction.

The hydraulic chambers 7 and 9 are each defined with the oil seal 20 in a liquid tight manner. As illustrated in FIG. 1(*a*), the oil seal 20 provided in the vane 5 is engaged with a groove portion 5*a* formed on an optical surface of the vane 5 and is configured to slide with respect to an inner circumferential surface of the housing 4. The oil seal 20 provided in the tooth 6 is engaged with a groove portion 6*a* formed on an optical surface of the tooth 6 and is configured to slide with respect to an outer circumferential surface of the rotor 3. As illustrated in FIGS. 1(*b*) and 1(*c*), a leaf spring 9 is arranged between the oil seal 20 and each of groove bottom surfaces of the groove portions 5*a* and 6*a*. With the leaf spring 9, one side surface of the oil seal 20 (hereinafter referred to as bottom surface 21) is pressed against the inner circumferential surface of the housing 4 or the outer circumferential surface of the rotor 3.

Figure 2A:
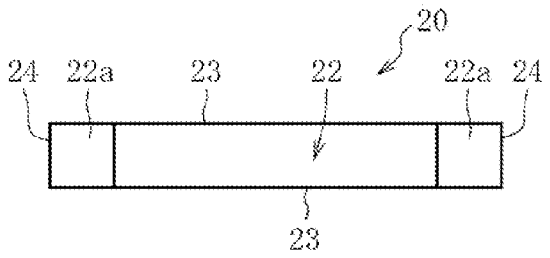
FIG. 2(*a*) is a plan view of an oil seal to be incorporated in the variable valve timing mechanism.
Figure 2B:
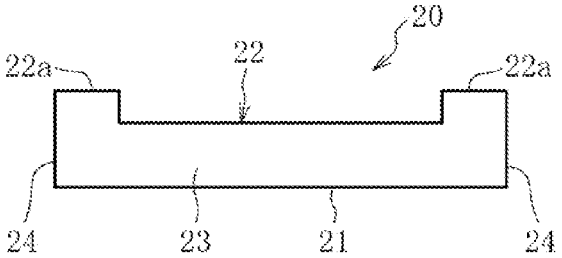
Figure 2C:
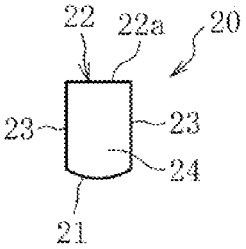

As illustrated in FIGS. 2(*a*) to 2(*c*), the oil seal 20 includes: the bottom surface 21; a side surface provided on the opposite side of the bottom, surface 21 (hereinafter referred to as top surface 22); a pair of flat side surfaces 23, 23 provided on both sides of the bottom surface 21 in a shorter direction; and a pair of flat side surfaces 24, 24 provided on both sides of the bottom surface 21 in a longer direction. A pair of convex portions 22*a* is formed on both ends of the top surface 22 in the longer direction, and the leaf spring 9 is installed between the pair of convex portions 22*a* (see FIGS. 1(*b*) and 1(*c*). The bottom surface 21 is formed into a convex cylindrical surface form with its center portion in the shorter direction as a top, as exaggeratingly illustrated in FIG. 2(*c*).

The oil seal 20 is formed of an iron-based sintered metal. Specifically, the oil seal 20 is formed of an iron-based sintered metal having an iron structure formed mainly of a ferrite phase and having blended therein copper and tin for bonding the iron structures to each other. The iron structures are bonded to each other with a copper-tin alloy. The oil seal 20 according to this embodiment is formed of an iron-based sintered metal containing 1 to 10 wt % (preferably 1 to 8 wt %) of copper, 0.5 to 2 wt % of tin, and 0.1 to 0.5 wt % of carbon, with the balance being iron. The blending ratio of tin to copper is set to ⅕ or more and 1 or less in terms of weight ratio. The iron-based sintered metal contains free graphite. In this embodiment, most of carbon exists as free graphite in the iron-based sintered metal. In the iron-based sintered metal, copper and tin predominantly exist as the copper-tin alloy, and a structure of elemental copper or elemental tin hardly exists. Specifically, the ratio of the elemental copper structure to a copper component in the sintered metal is set to 5 wt % or less, and the ratio of the elemental tin structure to a tin component in the sintered metal is set to 0.1 wt % or less.

The oil seal 20 is formed by the following procedure: raw material powder obtained by mixing various powders is filled into a mold, followed by being compressed to form a green compact; and the green compact is sintered at relatively low temperature. The raw material powder is mixed powder containing as main components iron powder, copper powder, tin powder, and graphite powder. Various molding aids (a lubricant, a mold release agent, and the like) are added to the mixed powder as required. In this embodiment, there is used raw material powder containing iron powder, copper powder, tin powder, and graphite powder, and having blended therein zinc stearate as a lubricant. The raw material powder and a manufacturing procedure therefore are hereinafter described in detail.

As the iron powder, any known powder such as reduced iron powder or water-atomized iron powder may be used widely. In this embodiment, the reduced iron powder excellent in oil retaining property is used. The reduced iron powder has a substantially spherical shape as well as an irregular and porous shape. Further, the reduced iron powder has a sponge-like shape with minute projections and depressions provided on its surface, and hence the reduced iron powder is also called sponge iron powder. As the iron powder, there is used iron powder having a grain size of approximately from 40 μm to 150 μm and an apparent density of approximately from 2.0 to 2.8 g/cm$^3$. The apparent density is defined in conformity to the requirements of JIS Z 8901 (the same applies hereinafter). It should be noted that the oxygen content of the iron powder is set to 0.2 wt % or less.

As the copper powder, there may widely be used spherical or dendritical copper powder, which is generally used for a sintered metal. For example, electrolytic powder, water-atomized powder, or the like is used. It should be noted that mixed powder of the above-mentioned powders may be used as well. As the copper powder, there is used copper powder having a grain size of approximately from 20 μm to 100 μm and an apparent density of approximately from 2.0 to 3.3 g/cm$^3$. The copper powder is blended with a view to bonding the iron structures to each other through alloying with tin. In this context, the blending ratio between copper and tin is set so that almost the entire copper powder reacts with tin to form a liquid phase, and thereby penetrates between the iron structures.

As the tin powder, any known powder such as atomized tin powder is used. For example, there is used tin powder having a grain size of approximately from 10 to 50 μm and an apparent density of approximately from 1.8 to 2.6 g/cm$^3$. As the graphite powder, any known powder such as flake graphite powder is used. For example, the average grain size and the apparent density are set to approximately from 10 to 20 μm and approximately from 0.2 to 0.3 g/cm$^3$, respectively.

The raw material powder obtained by blending the above-mentioned powders includes mixed powder containing 1 to 10 wt % (preferably 1 to 8 wt %) of the copper powder, 0.5 to 2 wt % of the tin powder, and 0.1 to 0.5 wt % of the graphite powder, with the balance being the iron powder, and has a trace amount of zinc stearate powder added to the mixed powder. It should be noted that the blending ratio of the tin powder to the cooper powder is set to ⅕ or more and 1 or less in terms of weight ratio.

Figure 3:
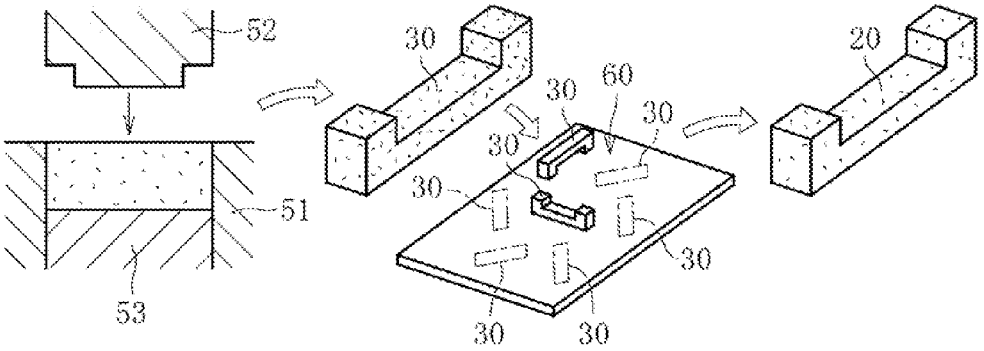
FIG. 3 is a schematic perspective view illustrating manufacturing steps for the oil seal.

The raw material powder having the above-mentioned composition is subjected to mixing by means of a known mixer, and then fed to a mold of a molding machine. As illustrated in FIG. 3, the mold is constructed of a die 51, an upper punch 52, and a lower punch 53, and the raw material powder is filled into a cavity defined by those components. When the upper and lower punches 52 and 53 are brought close to each other to compress the raw material powder, the raw material powder is molded by a molding surface defined by an inner peripheral surface of the die 51, and end surfaces of the upper and lower punches 52 and 53, to thereby obtain a green compact 30 having substantially the same shape as the oil seal 20.

The green compacts 30 are transferred onto a heat-resistant supporting member 60 (for example, a mesh belt) in a non-aligned state in which their directions and postures are not uniformized. Then, the green compacts 30 are sintered in a sintering furnace after being carried therein together with the heat-resistant supporting member 60. The sintering conditions are set so that carbon contained in graphite is prevented from reacting with iron (carbon is prevented from being diffused), and molten tin is brought into contact with copper to form a liquid phase in an alloy state. Specifically, the sintering temperature is set to from 750 to 900° C., preferably from 800 to 850° C. Further, in the conventional manufacturing steps for the sintered metal, endothermic gas (RX gas) obtained through thermal decomposition of a mixture of liquefied petroleum gas (such as butane or propane) and air with a Ni catalyst is often used as a sintering atmosphere. However, in the case of using the endothermic gas (RX gas), the hardening of the surface may occur through the diffusion of carbon. Thus, the sintering atmosphere is set to a gas atmosphere that does not contain carbon (hydrogen gas, nitrogen gas, argon gas, or the like), or to a vacuum. By virtue of those measures, carbon and iron do not react with each other in the raw material powder, and hence a hard structure formed of a pearlite phase λFe (HV 300 or more) is not precipitated. Therefore, the iron structure obtained after the sintering is formed mainly of a relatively soft ferrite phase αFe (HV 200 or less). In this embodiment, almost the entire iron structure (for example, 95 wt % or more of the iron structure) is formed of such ferrite phase. Along with the sintering, zinc stearate blended as a lubricant in the raw material powder is vaporized from inside a sintered compact.

As described above, the iron-based sintered metal formed mainly of a ferrite phase obtained by the sintering at relatively low temperature has low strength as compared to an iron-based sintered metal formed mainly of a pearlite phase. However, in this embodiment, the bonding strength between the iron structures is increased because the copper powder and the tin powder having high wettability to copper are blended in the raw material powder, and hence liquid phase sintering by the copper-tin alloy progresses. That is, even when the copper powder alone is blended in the raw material powder, the iron structures cannot be bonded to each other because copper does not melt at the above-mentioned sintering temperature. In addition, when the tin powder alone is blended in the raw material powder, the strength is not that increased because tin has low wettability to iron and the bonding force between tin and iron is small, while tin melts at the above-mentioned sintering temperature. Therefore, the copper powder and the tin powder are blended in the raw material powder to allow for progression of the liquid phase sintering. The strength can be ensured at a certain level by copper and tin penetrating between the iron structures and thereby bonding the iron structures to each other.

In addition, when the sintering is performed at relatively low temperature as described above, deformation such as bending or warpage is less caused by heat during the sintering. Therefore, dimensional accuracy demanded for the oil seal 20 can be obtained without uniformizing the directions and postures of the green compacts during the sintering. Therefore, there is no need to align the plurality of green compacts 30 on the heat-resistant supporting member 60. Thus, the operation is simplified and the risk of damaging the green compacts can be avoided in the alignment operation.

In addition, when the sintering is performed at relatively low temperature as described above, carbon in graphite is hardly diffused in the iron structure. In particular, in this embodiment, the copper-tin alloy penetrates between the iron structures, and hence carbon in graphite is prevented from being diffused in the iron structure. With such constructions, little graphite is diffused in the iron structure, and almost the entire graphite remains as free graphite. The free graphite is exposed to the entire surfaces of the oil seal 20 including the bottom surface 21.

Through the above-mentioned sintering step, a porous sintered compact is obtained. Barrel treatment and sizing are carried out on the sintered compact as required, to thereby complete the oil seal 20 illustrated in the figures. As described above, at the time of the sintering, carbon and iron do not react with each other so that the iron structure is formed of the soft ferrite phase. As a result, the sintered compact is likely to flow plastically at the time of the sizing, and hence the sizing can be performed with high accuracy. It should be noted that any one or both of the barrel treatment and the sizing step may be omitted unless otherwise required.

Figure 4:
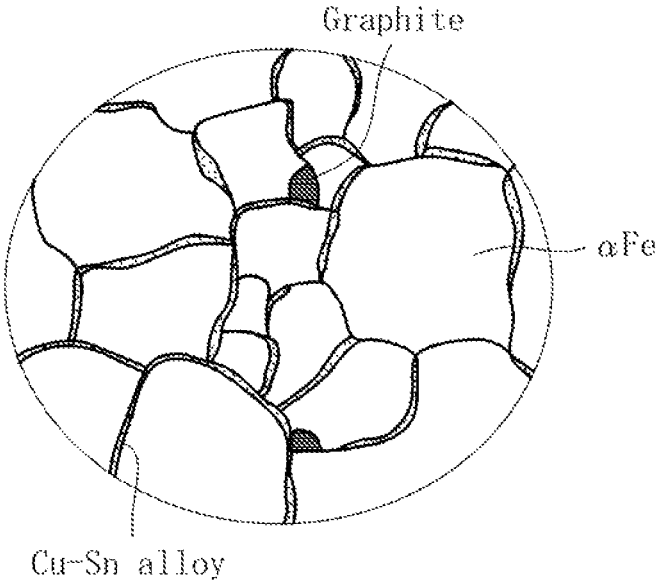
FIG. 4 is an enlarged view of a surface structure of the oil seal.

As illustrated in FIG. 4, in a metal structure on the surface of the oil seal 20 obtained through the above-mentioned manufacturing steps, a copper-tin alloy (represented by a dotted area) penetrates between iron structures each formed of a ferrite phase, αFe, and the iron structures αFe are bonded to each other with the copper-tin alloy, when the iron structure is formed mainly of a ferrite phase as just described, the oil seal 20 is softened, and hence the aggressiveness against the housing 4 or the rotor 3 can be reduced. In addition, free graphite (represented by a solid black area) is present in a scattered manner in the metal structure, and hence the slidability with respect to the housing 4 or the rotor 3 can be enhanced by the free graphite being exposed to a slide surface (the bottom surface 21 of the oil seal 20).

The present invention is not limited to the above-mentioned embodiment. For example, graphite may not be blended in the case where the machine part is not a slide part, which is configured to slide with respect to another member, while the case of blending graphite in the raw material powder for the sintered metal and dispersing the graphite as free graphite in the sintered metal is presented as an example in the above-mentioned embodiment.

In addition, while the case of applying the present invention to an oil seal tor a variable valve timing mechanism is presented in the above-mentioned embodiment, the application of the present invention is not limited thereto. The present invention can be preferably applied to any machine part to be used for an application in which a relatively small load is applied (for example, a bearing or a gear).

REFERENCE SIGNS LIST

1 variable valve timing mechanism
3 rotor
4 housing
9 leaf spring
20 oil seal (machine part)
30 green compact
51 die
52 upper punch
53 lower punch
60 heat-resistant supporting member
S cam shaft

The invention claimed is:

1. A machine part, comprising an iron-based sintered metal, the iron-based sintered metal having iron structures formed mainly of a ferrite phase, wherein the iron structures are bonded to each other with a copper-tin alloy, and wherein the iron-based sintered metal consists of 1 to 10 wt % of copper, 0.5 to 2 wt % of tin, and 0.1 to 0.5 wt % of carbon, with the balance being iron.

2. The machine part according to claim 1, wherein the machine part has a blending ratio of tin to copper of ⅕ or more and 1 or less in terms of weight ratio.

3. The machine part according to claim 1, wherein some or all of the carbon is free graphite.

* * * * *